US006431405B2

(12) United States Patent
Irwin

(10) Patent No.: US 6,431,405 B2
(45) Date of Patent: Aug. 13, 2002

(54) COMBINED FLUID AND POP-UP SHEET PRODUCT DISPENSING SYSTEM

(76) Inventor: Aram J. Irwin, 4924 NE. Mallory Ave., Portland, OR (US) 97211

( * ) Notice: Subject to any disclaimer, the term of this patent is extended or adjusted under 35 U.S.C. 154(b) by 0 days.

(21) Appl. No.: 09/739,532

(22) Filed: Dec. 13, 2000

Related U.S. Application Data

(60) Provisional application No. 60/179,303, filed on Dec. 13, 1999.

(51) Int. Cl.[7] ..... B67D 1/07
(52) U.S. Cl. ..... 222/192
(58) Field of Search ..... 222/181, 183, 222/192, 324, 386, 383.1; 206/225, 226

(56) References Cited

U.S. PATENT DOCUMENTS

| | | | | |
|---|---|---|---|---|
| 603,316 | A | 5/1898 | Bush | |
| 1,255,772 | A | 2/1918 | Miller | |
| 1,523,297 | A | 1/1925 | Savery | |
| 1,582,645 | A | 4/1926 | Findley | |
| 3,865,271 | A | 2/1975 | Gold | 221/96 |
| 4,436,224 | A | 3/1984 | McInerny | 222/183 |
| 4,516,676 | A | 5/1985 | Cournoyer | 206/226 |
| D363,214 | S | 10/1995 | Parola et al. | D9/300 |
| 5,671,872 | A | 9/1997 | Daniels, Jr. | 222/192 |
| 5,819,989 | A | 10/1998 | Saraceni | 222/192 |
| D406,976 | S | 3/1999 | Baggett | D6/521 |
| 6,138,874 | A | * 10/2000 | Audrey | 222/192 |
| 6,216,920 | B1 | * 4/2001 | Baggett | 222/192 |

* cited by examiner

*Primary Examiner*—Philippe Derakshani
*Assistant Examiner*—Thaeh H. Bus

(57) ABSTRACT

A system combining a fluid dispenser (10) and a pop-up sheet dispenser (12). The fluid dispenser is a bottle (14) with a spray pump (18), while the sheet dispenser (12) is a tub (28) with an opening (30) through which sheets pop out. The two dispensers snap together to trap and store sheets from a longitudinally folded web ready for pop-out dispensing. The primary embodiment may be used for spray cleaner and paper towels, for example. The sheet dispenser (12) provides the system's base, dispensing from a roll (29) with its core (44) held vertically in the tub (28), located by the tub's core-locating hub (40). The fluid dispenser (10) snaps vertically down into the sheet dispenser (12), acting as its lid and further locating the roll (29) with its hub-stem (26). The roll (29), held loosely by the two hubs, may spin within the system. The tub (28), opening (30), and roll (29) may together rotate relative to the fluid dispenser (14) to reorient the opening (30).

In a secondary embodiment, the sheet dispenser (112) dispenses from a stack (129) held vertically between the the bottle (114) and the tub (128) which are side-by-side and snap together horizontally. Again, the bottle (114) acts as a lid for the tub (128).

A tertiary embodiment demonstrates how the primary embodiment may be reapplied to other products, such as cosmetic fluids and sheets.

20 Claims, 5 Drawing Sheets

COMBINED FLUID AND POP-UP SHEET PRODUCT DISPENSING SYSTEM

CROSS-REFERENCE TO RELATED APPLICATIONS

This application is entitled to the benefit of Provisional Patent Application Ser. No. 60/170303, filed Dec. 13, 1999, which is incorporated here by reference.

This application hereby incorporates by reference, in its entirety and for all purposes, my U.S. patent application, Ser. No. 09/737,608, filed Dec. 13, 2000, titled "Pop-Up Sheet Product Dispensing System," naming Aram J. Irwin as inventor.

BACKGROUND

1. Field of Invention

This invention is directed toward combined dispensing of related but dissimilar items, more specifically to an improved system for the combined dispensing of fluid and sheet products.

The invention is also directed toward a method for dispensing fluids in combination with sheet products.

2. Description of Prior Art

Fluid and sheet products are frequently intentionally combined in use across a broad range of applications, from liquid cleansers and paper towels to cosmetic liquids and pads. Managing these combinations of separate items is usually somewhat involved and can be inconvenient.

A good example of such inconvenience can be found in the difficulties surrounding using a spray cleaner in combination with a roll of paper towels. Spray cleaners are usually used in combination with paper towels, typically on a roll. But without a third hand, it becomes difficult to juggle the roll of towels, the sprayer, and the wad of towels used to wipe with. So in the process of cleaning, consumers usually end up constantly picking up and putting down the bulkiest item, the towels. In the process, the towels often get wet or dirty (after all, it is usually wet or dirty where one is cleaning), knocked over, or squashed, or the roll can roll away or become unraveled, wasting towels or forcing consumers to sloppily re-roll them, etc. Additionally, it can be frustrating to find both sprayer and towels when they are needed, since although they are frequently used together, they are not typically stored together. This is due not only to the large size and considerable bulk of the roll of towels, but also to the fact that the towels are just as susceptible to unwinding and getting wet or dirty in storage as they are in use.

So it is evident from the above example that it would be desirable to provide means which would not only allow the user to find both fluid and sheets readily at hand when needed, but would also: allow the user to dispense both freely while still having a free hand to use the dispensed items; prevent the towels from unraveling; protect them from getting wet or dirty; and store them safely and space-efficiently.

Many further examples of the difficulty of managing separate fluid and sheets exist, but the above example should be sufficient to illustrate the overall nature of such problems.

Consequently, many developments have been attempted with the goal of more conveniently combining fluids and sheet products.

Three primary directions have resulted:

The first direction has been to pre-combine fluid and sheets in non-dispensing single compartment package, and numerous pre-moistened wipes and the like of such nature have been developed. However, this overall approach has a number of major inherent disadvantages, including: the consumer loses the ability to control the amount of fluid applied to the sheet; pre-moistened sheets are not wet enough to thoroughly saturate a surface; they are not dry enough to wipe surfaces dry; the fluid and sheet material may not react well together over time and may so become degraded; and it is difficult to retain moisture in the sheets and expensive to provide the packaging to do so.

The second direction has been to combine fluid packages and sheet packages in joined or multi-compartment packages in which one or both compartments are non-dispensing. While this approach allows users to readily find and transport necessary items together from location to location, such packages must be disassembled into separate parts before use, in which case the user ends up with the typical set of previously described problems associated with the manipulation and use of separate sheet product and fluid product items.

The third direction has been to create devices which allow for simultaneous dispensing of both products without requiring any disassembly, essentially unified dispensers rather than combined packages. Such unified dispensers are usually either fixed, portable, or mobile. Fixed dispensers are intended for constant use in a single location only (such as U.S. Pat. No. 1,582,645, a "Combination Liquid Soap Dispenser and Towel Rack," issued to W. F. Findley in 1926), while portable dispensers may be moved occasionally from location to location (such as the free-standing embodiment of U.S. Pat. No. 3,865,271, a "Dispenser and Liquid Applicator for Toilet Paper, Paper Towels, and the Like" to Gold in 1975), and mobile dispensers are intended for constant, uninterrupted movement both from location to location and within a location. Since the present invention relates primarily to the mobile variety of dispensers, further discussion here will focus substantially on prior art which has wholly or partly attempted to address the issue of mobility. Since I will be showing that none of these devices are truly mobile, I will refer to them as semi-mobile systems.

Many examples of semi-mobile combined fluid and sheet dispensers exist in the prior art, dating back many years; yet none have achieved widespread and lasting commercial success. The prior art clearly demonstrates a long-felt need, but configurations provided have all been cumbersome, inconvenient, or incomplete. A further review of the most pertinent prior art should serve to underscore this point:

An early phase of development in the prior art is described by a series of U.S. Patents: U.S. Pat. No. 603,316, to J. W. Bush in 1898, U.S. Pat. No. 1,255,772 to Miller in 1918, U.S. Pat. No. 1,523,297 to Savery in 1925, and U.S. Pat. No. 4,516,676 to Cournoyer in 1985. All describe essentially the same overall configuration: a cylindrical sheet roll dispenser with a narrow slit out of which to dispense the towels; and a second and smaller cylindrical dispenser for fluid located entirely within the core of the sheet roll. At the point of fluid dispensing, Bush describes a dipping wand, Miller a plain threaded cap, Savery a nozzle, and Cournoyer a small pump. The above combined dispensers all had many inherent disadvantages: they required consumers to thread towels through a very narrow slot in a very confined space; they provided only limited fluid reservoirs given the small size of the towel roll core; they provide inadequate gripping means; and they were all only semi-mobile. Bush's, Miller's and Savery's devices would require constant picking up and putting down, because they all require two-handed operation and leave no hand free for using dispensed product or holding items to be cleaned. Coumoyer's device would be exceedingly awkward to use in mid-air and would likely need to be first put down on a surface before it could be properly operated. Thus, in addition to numerous other problems, none of these devices were truly mobile.

A further phase of development in the prior art seems to address the issue of limited fluid space provided in the towel roll core in earlier devices. U.S. Pat. No. 4,436,224 to McInerny in 1984, U.S. Pat. No. 5,671,872 to Daniels, Jr., in 1997 and U.S. Pat. No. 5,819,989 to Saraceni in 1998, all illustrate the same new configuration: rather than confining the fluid reservoir to the space within the towel roll, they expand the reservoir outside the towel roll and to the opposite end away from their fluid dispensing outlet. These devices are essentially spray or pump bottles with long necks going through paper towel rolls. This overall configuration has many inherent disadvantages: bottles with such long necks and such wide bases are difficult and exceedingly expensive to mold (in fact, it is often not reasonably possible to mold such packages in plastics which require stretch-blow molding, such as the most typical kinds of very clear plastic used in packaging today); long-necked, wide-based bottles are also exceedingly difficult to empty in use, because the diptubes, once down the long neck, cannot draw from the wide base when the package is partially emptied and angled in use (spray packages are in fact most often angled in use, so this is a real issue); long-necked, wide-based bottles are also difficult for manufacturers to fill on the packing line because fluid fills the base slowly and then suddenly shoots up when it reaches the neck, creating the potential for spills; long-necked, wide-based bottles are further hard to fill on manufacturer's packing lines because bottles require a certain amount of empty headspace by volume which appears exaggerated in a long neck and is objectionable to consumers who think they're being shorted; bottles which are too tall and unstable (in this case, primarily the Daniels, Jr. bottle) can't be filled on a manufacturing line without the use of special and costly "puck" systems to allow the bottles to stand vertically upright for filling; since the towel rolls must slide down over these thin necks, it is no longer possible to have an ergonomically superior angled "pistol grip" shaped neck inexpensively molded into the bottle, otherwise the current norm for trigger sprayer bottles; the towels are now exposed and unprotected, not only to contamination by the surrounding environment, but by the system itself, since the towels are directly under the dispenser nozzle, where they will likely be spoiled by drips; the devices are large, ungainly and awkward to handle (the McInerny device provides no gripping means and is thus, like the Cournoyer device above, essentially only suitable for countertop use, while the Daniels and Saraceni patents both suffer from a low center of gravity far from the hand, which would make them unusually difficult to rotate and maneuver in use, even granted their huge size); and none of these systems allow for true mobile use. The McInerny device was probably never intended for true mobile use, given the suitability for countertop use only noted above. And neither the Saraceni nor the Daniels device provided any means for towel stopping when tearing. Which meant the user of either of these devices would have had to simply try to rip towels off, one-handed, as fast as possible, hoping they could break a towel free before the whole roll unraveled. Of course this is impractical and must frequently if not usually have failed. Therefore, the users themselves would have had to provide the braking, giving up their grip on the trigger sprayer and braking the roll with one hand to pull a towel free with the other. This would leave one with a dispensed towel in one hand and the body of the towels in the other. Some juggling would then have to be done and something likely put down and picked up again to regain a grip on the trigger sprayer, thereby canceling out the advantages of this purportedly mobile system. Thus, in addition to numerous other problems, none of these devices were truly mobile.

Additionally, the broadest possible commercial application for such combined dispensing devices is in the arena of disposable packaged goods, where they would be sold next to their counterparts, the individually packaged products they combine, e.g., alongside paper towels in the supermarket paper towel aisle or alongside spray cleaners in the cleaner aisle. However, none of the prior art specifically mentioned above would be suitable for such sale, because all the devices have one or more of the following problems: too expensive to be disposable and sold alongside disposable; too big or bulky to fit on standard supermarket shelves; no protected area for a label; too difficult or expensive to package for sale; too unattractive to be appealing to consumers; not obvious enough for shoppers to quickly understand.

Finally, all instances of the prior art specifically mentioned above dispense paper towel rolls, while none seek to novelly improve the manner in which individual towels are dispensed. The present invention, however, will utilize my co-pending patent for reliable and inexpensive pop-up dispensing from a continuous, perforated web, which will eliminate all the difficulty associated with standard dispensing from a roll, such as off-perforation tearing, overdispensing, unraveling, or the need to use two hands, and will instead provide all the ease-of-use and one-handed benefits inherent to pop-up dispensing systems.

SUMMARY

A combined dispensing system comprising a fluid dispenser and a pop-up sheet dispenser which snap together to trap and store sheets ready for pop-out dispensing. The system allows for simultaneous one-handed dispensing of either dispenser, and lets a user clean uninterrupted while walking around and without having to stop to set anything down. The sheets are double-folded, so they take up less space and provide for a smaller system, and held in a container and protected from getting wet, dirty, or deformed. The system is small, convenient, inexpensive and easy to use or store.

Further, it may readily be adapted to the combined dispensing of other related fluids and towels, such as cosmetics and cosmetic pads.

Objects and Advantages

Accordingly, several objects and advantages of my invention are to provide a combined fluid and sheet material dispensing system which:

- is always immediately ready for use without requiring any assembly or disassembly (other than refilling);
- provides easy refilling and rethreading of sheet material;
- protects sheet products from dirt, moisture and other contaminants, both in use and in storage;
- protects sheet products from being crushed, wrinkled, or otherwise physically malformed, both in use and in storage;
- reduces bulk of paper towels while still allowing dispensing of full-size material;
- reduces overall bulk of dispenser; thus making it more convenient to hold, carry or store;

has an ample fluid reservoir commensurate to the quantity of sheet material being dispensed;

can be stored in environments normally damaging to sheet materials;

can readily access and dispense nearly 100% of its fluid reservoir at nearly any common angle of use;

provides a package with a center of gravity higher and closer to the hand aiding in package rotation and maneuvering in use;

provides a package of conveniently small size for use;

permits inexpensively molding a superior ergonomic grip into the bottle;

is so inexpensive to manufacture that it can be considered disposable;

can be readily stretch-blow molded in crystal clear plastic;

can be readily filled on the manufacturer's packing line without requiring a puck system;

can be readily filled on the manufacturer's line without the appearance of objectionable underfill;

is small enough to fit on standard supermarket shelves;

is suitable for sale without any additional packaging other than a label;

provides a protected area for a label;

is attractive enough to be appealing to consumers;

and is obvious enough to be readily understood by consumers.

Further objects and advantages of my invention are to provide a combined fluid and sheet material dispensing system which:

provides control over sheet products such that they do not accidentally self-dispense, both in use and in storage;

provides means for a single sheet to be dispensed without requiring a second hand to restrain the remainder of undispensed sheets;

allows the user a free hand to use dispensed products;

does not in any part need to be set down in use or during use of any subsequent products dispensed from it;

eliminates negatives of typical roll-dispensing systems, such as off-perforation tearing, overdispensing, unraveling, or the necessity of two handed dispensing;

allows for simple, pop-up dispensing of sheet materials; and provides truly one-handed mobile operation, allowing constant, uninterrupted use both from location to location and within a location.

Further objects and advantages of my invention will become apparent from a consideration of the drawings and ensuing description.

DRAWING FIGURES

In the drawings, closely related figures have the same number but different alphabetic suffixes.

Figure 1A:
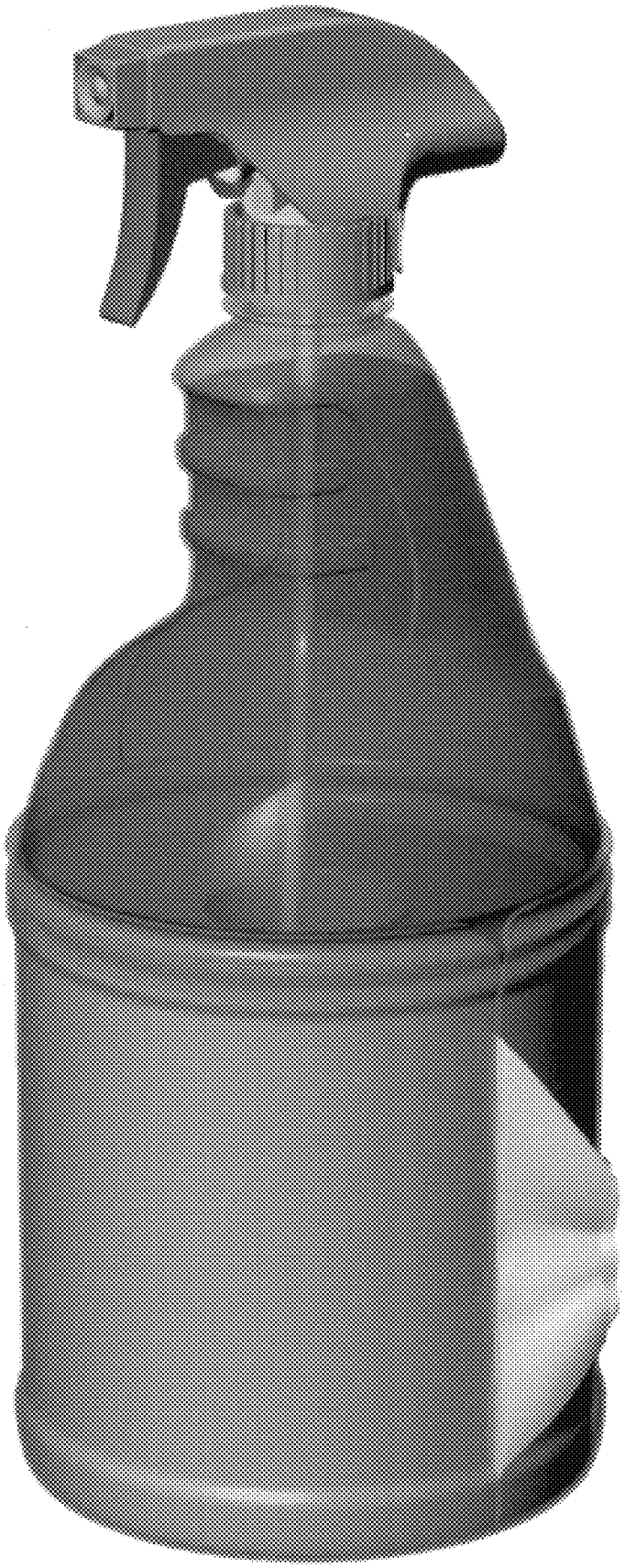
FIG. 1A is a perspective view of the preferred embodiment of the system of the present invention fully loaded and ready for use.

| REFERENCE NUMERALS IN DRAWINGS | |
|---|---|
| 10 | fluid dispenser |
| 12 | pop-up sheet dispenser |
| 14 | bottle |
| 16 | screw threads |
| 18 | pump |
| 20 | diptube |
| 22 | neck |
| 24 | female snap-groove |
| 26 | roll-locating hub stem |
| 28 | tub |
| 30 | dispensing slot |
| 32 | lead-in notch |
| 34 | male snap-groove |
| 36 | recessed label panel |
| 38 | bump-guards |
| 40 | roll-locating push-up hub |
| 42 | bottle push-up indentation |
| 44 | roll core |
| 46 | pop-up presentment |
| 48 | dispensed sheet |
| 50 | leading sheet |
| 52 | capping region |
| 110 | (2nd) fluid dispenser |
| 112 | (2nd) sheet dispenser |
| 114 | (2nd) bottle |
| 116 | (2nd) screw threads |
| 118 | (2nd) pump |
| 120 | (2nd) diptube |
| 122 | (2nd) neck |
| 124 | (2nd) female snapgroove |
| 128 | (2nd) tub |
| 129 | (2nd) stack |
| 130 | (2nd) dispensing slot |
| 134 | (2nd) male snap groove |
| 146 | (2nd) pop-up presentment |
| 152 | (2nd) capping region |

DESCRIPTION—FIGS. 1A TO 1E—PREFERRED EMBODIMENT

Figure 1B:
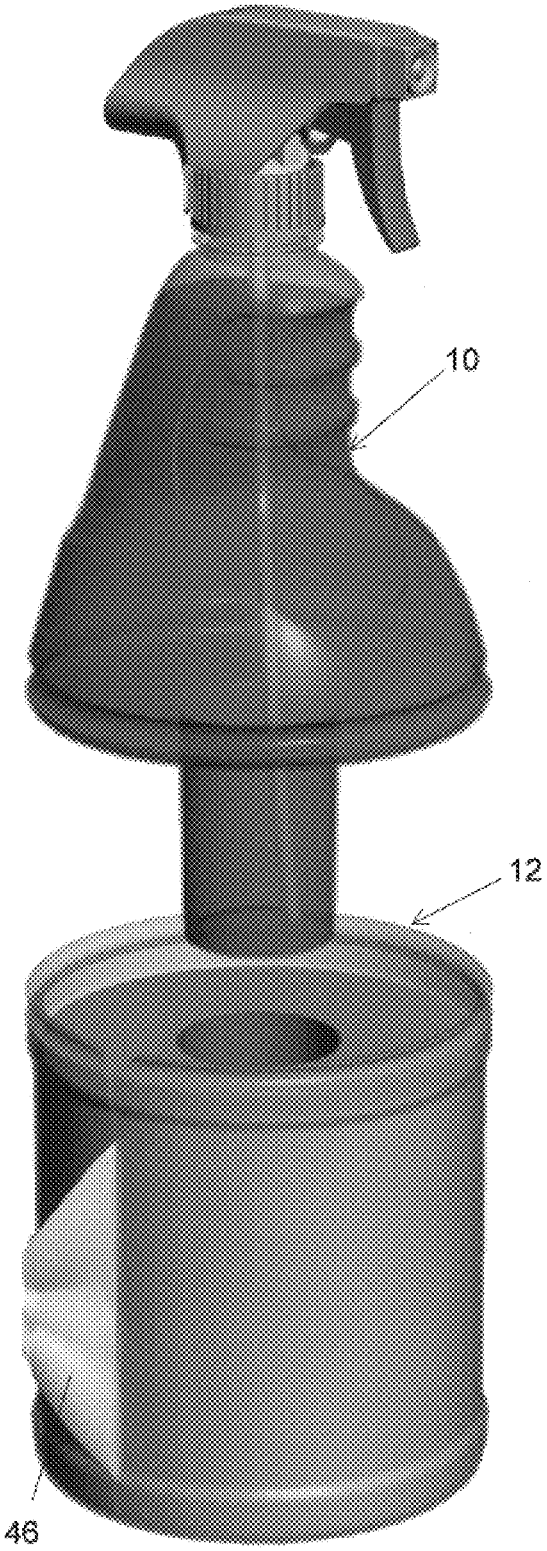
FIG. 1B shows the system loaded and disassembled into its two major sub-dispensers.

FIG. 1A shows the preferred embodiment of the combined dispensing system of the present invention system assembled and fully loaded with product. FIG. 1B shows the system taken apart into its two sub-dispensers, an upper fluid dispenser 10 and a lower sheet dispenser 12.

Figure 1C:
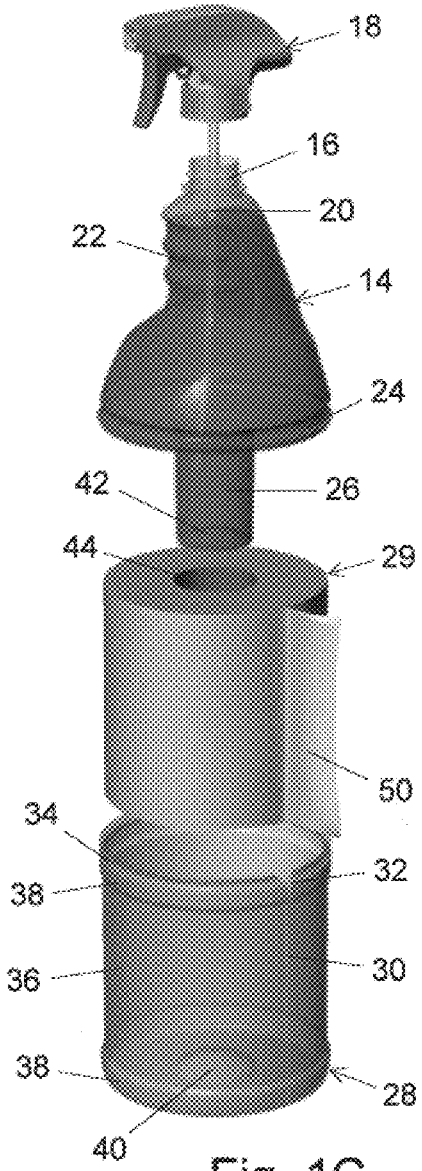
FIG. 1C shows the system loaded and further disassembled into relevant subcomponents.

FIG. 1C shows the fluid dispenser 10 and sheet dispenser 12 taken apart as well.

The upper fluid dispenser comprises a 22 oz. (including a small additional amount of room for headspace required in manufacturing) bottle 14, likely blow-molded HDPE (high density polyethylene) or stretch blow-molded PET (Polyethylene Terephthalate), with screw threads 16 (of course a bayonet mount or other attachement means could be used as well) for the attachment of a trigger-sprayer type pump 18 including a diptube 20. The bottle 14 further has an ergonomic pistol-grip neck 22, a concentric female snap-groove 24, and a roll-locating hub stem 26.

The lower sheet dispenser comprises a tub 28 and a roll 29 of full size perforated 9 by 11 inch paper towels prefolded in half longitudinally before rolling, such that the roll is only 4.5 inches tall. The towels are dispensed through a slot 30 with a lead-in notch 32. Of course, the towels need not be folded longitudinally; they could be cut down to 4.5 inches wide.

The sheet dispenser 12 is a Pop-Up Sheet Product Dispensing System as described in my following U.S. patent application, which is incorporated herein by reference: Ser. No. 09/737,608, filed Dec. 13, 2000 titled "Pop-Up Sheet Product Dispensing System," naming Aram Irwin as inventor. The sheet dispenser 12 could also dispense more common perforated towels.

The tub 28 further has a concentric male snap-groove 34 matching the female snap-groove 24 on the fluid dispenser's bottle 14, a recessed label panel area 36 bounded by upper and lower bump-guards 38 (which allow the systems to rub up against one another in the manufacturing and packing lines and on supermarket shelves without scuffing the label wrapped around the label panel area 36), and a bottom roll-locating push-up hub 40. The tub may be molded by a variety of means, including blow molding and stretch-blow molding, in which case the dispensing slot 30 and lead-in notch 32 are produced in a secondary operation on the manufacturing line after molding, and injection molding, in which case the slot 32 and lead-in notch b may be molded in.

Figures 1D, 1E:
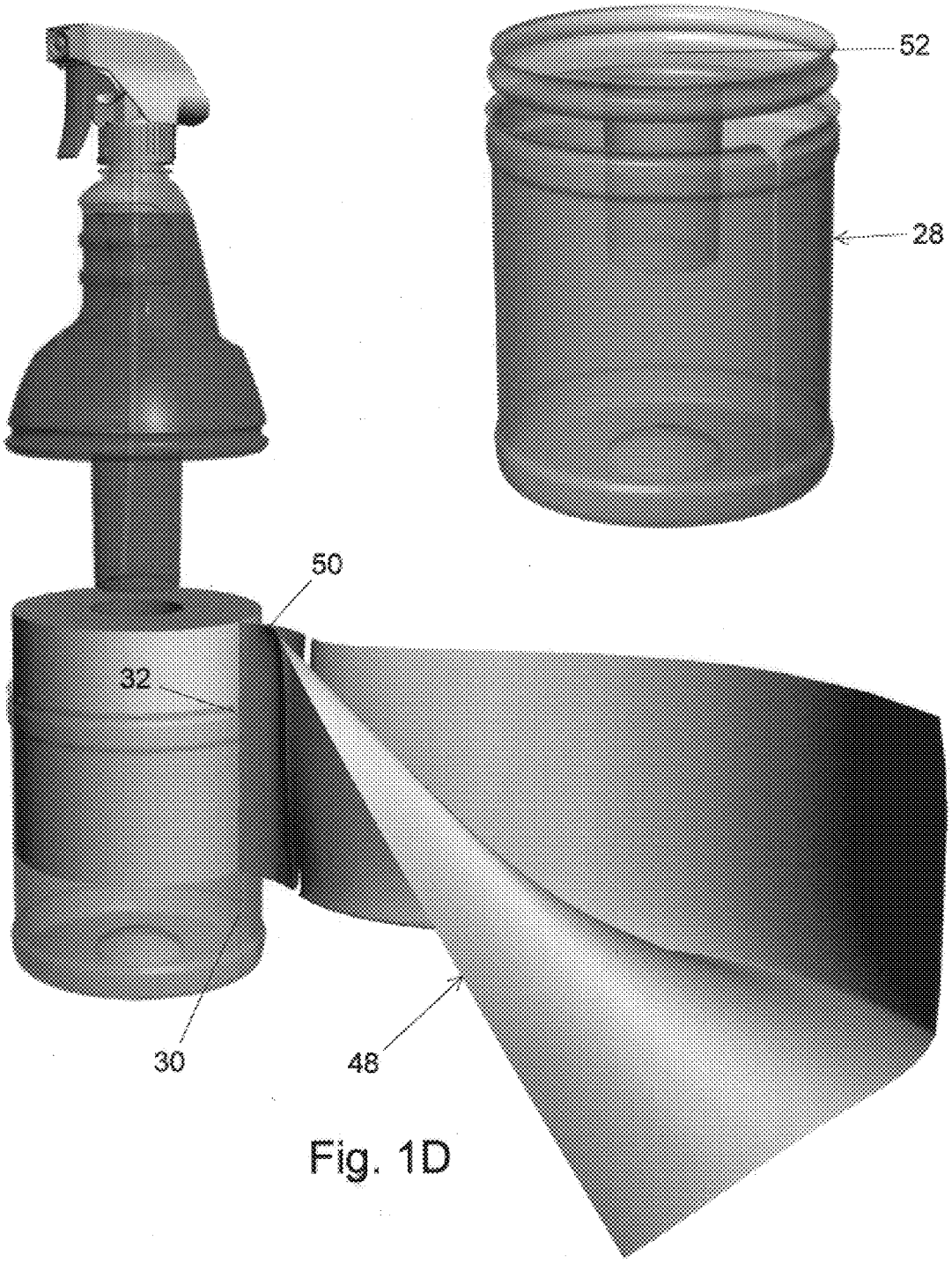
FIG. 1D shows the loaded fluid dispenser detached from the sheet dispenser and a roll of towels being loaded in or removed and further shows a double-folded sheet which has been drawn out.
FIG. 1E shows the system unloaded and with the rest of the fluid dispenser cut away from the capping region.

Note that the bottom portion of the fluid dispenser 14 including and below the female snap-groove 24 forms an integral, molded-in cap for the sheet dispenser. This capping region 52 is shown in FIG. 1E with the rest of the fluid dispenser 10 cut away for clarity.

After manufacture, the fluid dispenser 10 may be snapped into the sheet dispenser 12 and filled on a packing line without the need for pucks, since the broad base provided by the sheet dispenser 12 allows the fluid dispenser 10 to remain stable vertical.

Figure 1F:
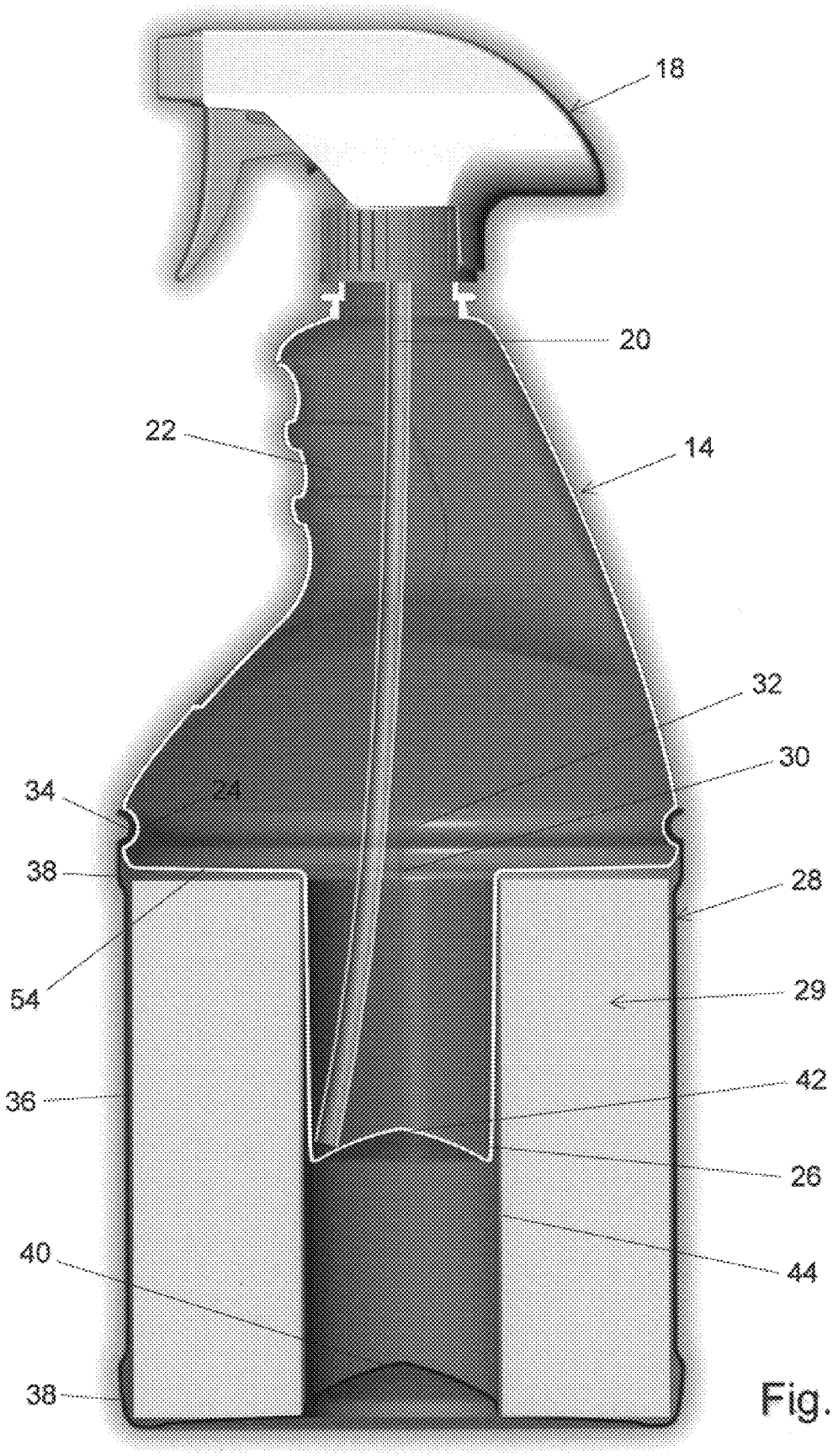
FIG. 1F is a right view of the system sheared in half.

So that the assembled system may be more clearly seen, FIG. 1F further shows the loaded system sheared in half in a right side view.

Referring to FIG. 1F, the bottle 14 has a push-up indentation 42 sufficiently deep so that it will not likely pop out in the other direction over time. This is so that the bottle 14 may reliably stand on the hub stem 26 during the brief periods of time the dispenser is disassembled for product loading. The diptube 20 is long enough so that when the pump 18 is screwed onto the bottle 14, the diptube hits the push-up indentation 42 inside and pushes off of it into the very bottom of the hub stem 26, thus ensuring that the pump 18 can almost completely empty out the bottle 14 in use. To ensure that no fluid is trapped in the upper portion of the bottle 14, the upper base wall is sloped downward very slightly, draining all fluid down into the hub stem 26. The hub stem 26 is also slightly tapered towards the bottom so that in assembly and refill it may easily locate and slide within the roll core 44.

Note here that the hub stem 26 could be longer or shorter: it could be barely a dimple, as long as it still gives the roll 29 something to spin on, or it could reach all the way to the bottom of the tub 28 to mate and interlock with the tub's roll-locating push-up hub 40, which could also be molded so it reaches further up into the roll core 44. However, making the hub stem 26 longer or the push-up hub 40 deeper could drive up manufacturing costs since such deep features would be harder to mold. Also, making the hub-stem 26 very short would not only eliminate a small quantity of fluid reservoir, it would effectively turn the bottle 14 into a very wide-based bottle, and such bottles are difficult to pump empty, as previously described in the background section above.

Since in operation the roll 29 must spin relative to the rest of the system, sufficient clearance must be provided between the outer portion of the roll 29 and the tub 38, between the roll core 44 and the hub stem 26, and between the roll core 44 and the roll-locating push-up hub 40. It may also be desirable to form the hub stem 26 with vertical facets, flutes, or the like, which would serve to protect the hub stem 26 from "panelling" or deforming over time, a typical problem with thin-walled cylindrical sections of bottles. If such panelling were to occur, it could cause the hub stem 26 to frictionally engage the roll core 44, making it difficult for the roll 29 to spin on the hub stem 26 in operation. Finally, the degree of fit between the bottle's male snap-groove 34 and the tub's female snap-groove 28 should be sufficient to ensure both packages remain firmly together during operation, but no so firmly that the fluid dispenser 10 and the sheet dispenser 12 may no longer rotate relative to one another, a desirable characteristic further explained in the operational section below.

OPERATION—FIGS. 1A TO 1F—PREFERRED EMBODIMENT

In operation: in one hand, the user holds the system in mid-air by the neck 22 with one or two fingers on the pump 18. The user may then proceed to spray surfaces needing cleaning, and when a towel is needed to wipe with, the pop-up presentment 46 protruding from the sheet dispenser's dispensing slot 30 may be readily grasped and pulled with the other hand. This rotates the roll of towels inside the stationary system, andvancing the web of the roll out of the dispensing slotproduces a full size, folded sheet 48, shown in FIG. 1D, which, in the manner of typical pop-up sheet dispensing systems, tears off by itself and leaves the next sheet from the roll 29 wedged in the dispensing slot, forming another pop-up presentment 46 for the next use. The user may draw forth this towel in virtually any manner, at any speed, in any direction, with essentially no attention given to the matter, and the pop-up system will still work. The user may then proceed to spray and wipe until the towel 48 is used up, at which point they may toss it out and pull forth another towel 48. In this fashion, the user may progress unhindered in their cleaning from location to location and throughout any given location, until either their fluid or towels run out, without ever having to set the system down, change grips, or deal with the many problems produced by non-pop-up towel dispensing. Thus, the system is truly mobile.

The system is also ambidextrous and adaptable to changing users or changing situations, because the towel dispenser 12 may be rotated at any time relative to the fluid dispenser 10, thus changing the orientation of the dispensing slot 30. The system is also to a degree self-correcting in terms of the alignment of the slot 30 relative to the user, since if sheets are tugged in a new direction, that action itself rotates the sheet dispenser 12 to a degree in the new direction. The degree of self correction is regulated by how easy it is to rotate the sheet dispenser relative to the fluid dispenser, a factor controlled by how tightly the snap-grooves 24 and 34 are designed to mate and the amount of frictional engagement they then produce in rotation, an amount that could vary considerably in different materials.

Although the system is designed to be inexpensive enough to dispose of, some consumers will choose to refill it.

To refill the fluid dispenser 10, the user would unscrew the pump 18 from the bottle 14, pour in new fluid, and screw the pump 18 back on the bottle 14. Note that the towel roll 29 remains fully enclosed and safe from drips and spills during this operation.

To refill the sheet dispenser 12, the user grasps the tub 28 firmly around the midsection with one hand and pops the fluid dispenser 12 out of the tub 28. One may then set the fluid dispenser 10 aside, standing on its hub stem 26. The used up roll core 44 may then be removed from the tub 28 and recycled. A refill roll 29 may be unwrapped and a leading sheet 50, seen in FIG. 1D, bent outwards and aligned with the lead-in notch. Roll orientation is essentially unimportant. The rolls may be loaded such that they spin clockwise or counterclockwise in dispensing, and they may be loaded in folded edge first or the opposite edge first. It may be very marginally easier to pull the folded edge of the lead sheet 50 in first, but this is a minor point. FIG. 1D then shows how a roll 29 may be simply slid into or out of the sheet dispenser 12, without difficult threading. The roll 29 should locate itself on the tub's roll-locating push-up hub 40. At this point, the fluid dispenser 10 may be retrieved and aligned with the sheet dispenser 12 by inserting the tip of the hub stem 26 into the roll core 44. The fluid dispenser and the sheet dispenser may then be snapped back together.

Note that because the dispensing slot 30 and lead-in notch 32 cut through the rim of the tub 28, the rim of the tub 28 is allowed to expand outwards. This expansion makes it easier to remove the fluid dispenser 10 from the sheet dispenser 12, easier to insert the fluid dispenser 10 back into the sheet dispenser 12, and easier to load a fresh roll of towels 29. The lead-in notch 32 and dispensing slot 30 are widened into a slight V-shape during the aforementioned expansion at the rim of the tub, making loading and unloading towels easier.

After reloading fluid or sheet materials, the system is then ready for re-use. After use, the system is immediately ready for storage by the user with no further effort, since the pop-up presentment 46, firmly grasped by the dispensing slot 30, prevents the roll 29 from accidental dispensing and blocks contaminants from entering the sheet dispenser. Given its relatively small size and the fact that its sheets are protected, it may then be stored almost anywhere.

DESCRIPTION—FIG. 2—SECOND EMBODIMENT

Figure 2:
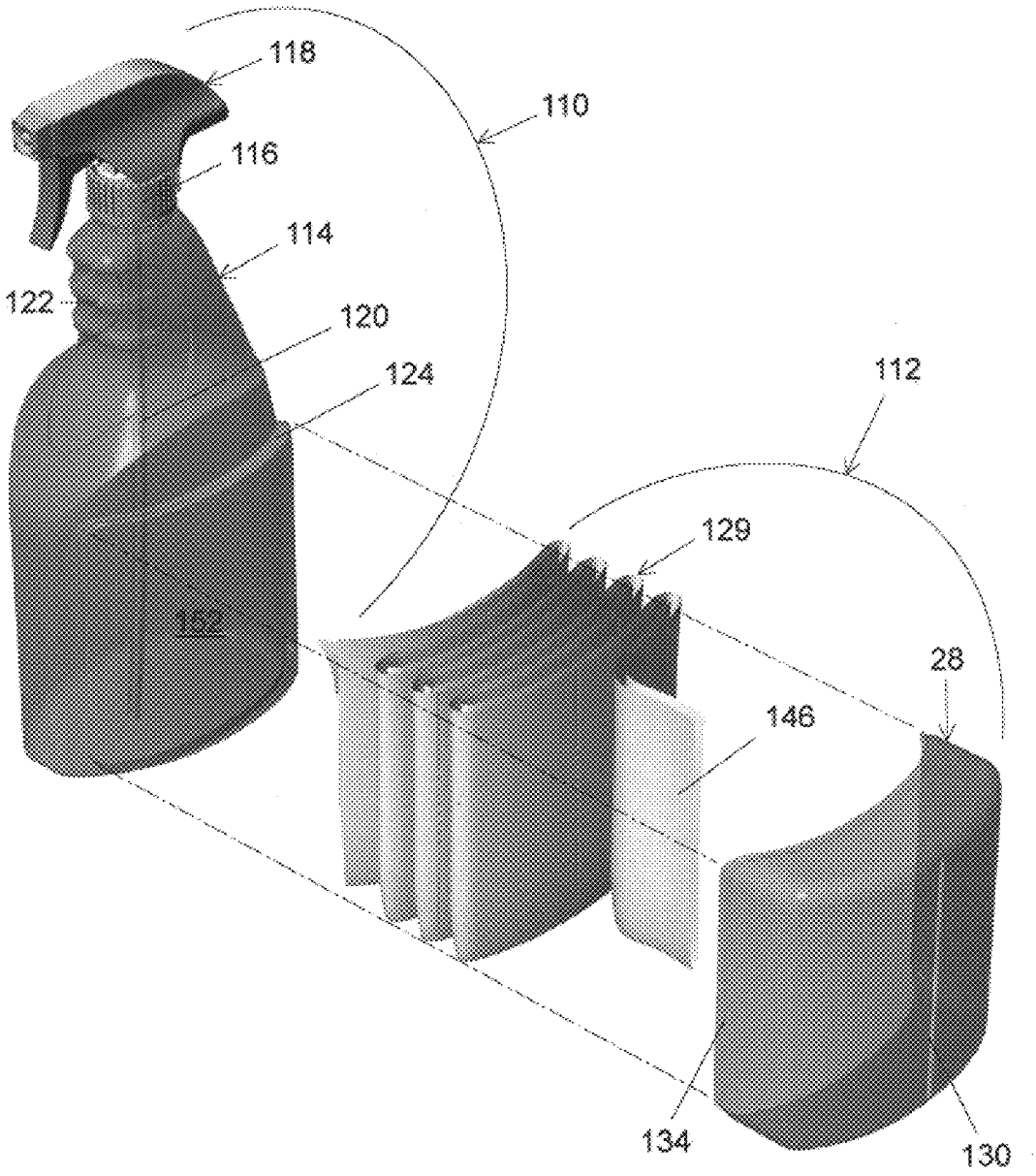
FIG. 2 shows the system of 2 fully disassembled into all its relevant subcomponents.

FIGS. 2 shows a second embodiment of the present invention.

The fluid dispenser 110 comprises a bottle 114, likely blow-molded HDPE (high density polyethylene) or stretch blow-molded PET (Polyethylene Terephthalate), with screw threads 116 (of course a bayonet mount or other attachement means could be used as well) for the attachment of a trigger-sprayer type pump 118 including a diptube 120. The bottle 114 further has an ergonomic pistol-grip neck 122, an integral, molded-in capping region 152 around which runs a female snap-groove 156.

The sheet dispenser 112 comprises a tub 128 and a sheet supply suitable for pop-up dispensing, comprising a perforated continuous web, which would preferably be longitudinally folded to provide for larger sheets, accordion folded into a stack 129. Of course, pre-cut separate sheets, z-folded into an interleaved stack suitable for pop-up dispensing could be used instead, but likely at greater expense. The towels are dispensed from the stack 129 through a dispensing slot 130. The tub 128 further has a concentric male snap-groove 134 matching the female snap-groove 124 on the fluid dispenser's bottle 114. The tub may be molded by a variety of means, including injection molding, in which case the dispensing slot 130 can be molded in, and vacuum-forming, blow molding and stretch-blow molding, in which case the dispensing slot 130 is produced in a secondary operation on the manufacturing line after molding.

Note that the portion of the fluid dispenser's bottle 114 which includes the the female snap-groove 124 and the portion of the bottle 114 it surrounds, form an integral, molded-in cap for the sheet dispenser, or capping region 152.

OPERATION—FIG. 2—SECOND EMBODIMENT

In operation: in one hand the user holds the system in mid-air by the neck 122 with one or two fingers on the pump 118. The user may then proceed to spray surfaces needing cleaning, and when a towel is needed to wipe with, the pop-up presentment 146 protruding from the sheet dispenser's dispensing slot 130 may be readily grasped and pulled by the other hand, advancing the web of the stack out of the dispensing slot to produce a sheet which, tears off by itself and leaves the next sheet from the stack 129 wedged in the dispensing slot 130, forming another pop-up presentment 146 for the next use. The user may draw forth this towel in virtually any manner, at any speed, in any direction, with essentially no attention given to the matter, and the pop-up system will still work. The user may then proceed to spray and wipe until the towel is used up, at which point they may toss it out and pull forth another towel. In this fashion, the user may progress unhindered in their cleaning from location to location and throughout any given location, until either their fluid or towels run out, without ever having to set the system down, change grips, or deal with the many problems produced by non-pop-up towel dispensing. Thus, the system is truly mobile.

Although the system is designed to be inexpensive enough to dispose of, some consumers will choose to refill it.

To refill the fluid dispenser, the user would unscrew the pump 118 from the bottle 114, pour in new fluid, and screw the pump 118 back on the bottle 114. Note that the towel stack 129 remains fully enclosed and safe from drips and spills during this operation.

To refill the sheet dispenser 112, the user grasps the tub 128 firmly around the midsection with one hand and pops it free from the fluid dispenser 112. A refill stack 129 may be then unwrapped and a placed inside the tub 128. The tub 128 may then be snapped back onto the fluid dispenser 110, and a lead sheet pulled through the dispensing opening 130 to form the first pop-up presentment 146.

After reloading fluid or sheet materials, the system is then ready for re-use. After use, the system is immediately ready for storage by the user with no further effort, since the pop-up presentment 146, firmly grasped by the dispensing slot 130, prevents the roll 129 from accidental dispensing and blocks contaminants from entering the sheet dispenser 112. Given its relatively small size and the fact that its sheets are protected, the system may then be stored almost anywhere.

CONCLUSION, RAMIFICATIONS, AND SCOPE

After reading the above descriptions of the invention, the reader will see that the combined fluid and sheet product dispensing system of the present invention: is always immediately ready for use without requiring any assembly or disassembly (other than refilling); provides easy refilling and rethreading of sheet material; protects sheet products from dirt, moisture and other contaminants, both in use and in storage; protects sheet products from being crushed, wrinkled, or otherwise physically malformed, both in use and in storage; reduces bulk of paper towels while still allowing dispensing of full-size material; reduces overall bulk of dispenser; thus making it more convenient to hold, carry or store; has an ample fluid reservoir commensurate to the quantity of sheet material being dispensed; can be stored in environments normally damaging to sheet materials; can readily access and dispense nearly 100% of its fluid reservoir at nearly any common angle of use; provides a package with a center of gravity higher and closer to the hand aiding in package rotation and maneuvering in use; provides a package of conveniently small size for use; permits inexpensively molding a superior ergonomic grip into the bottle; is so inexpensive to manufacture that it can be considered disposable; can be readily stretch-blow molded in crystal clear plastic; can be readily filled on the manufacturer's packing line without requiring a puck system; can be readily filled on the manufacturer's line without the appearance of objectionable underfill; is small enough to fit on standard supermarket shelves; is suitable for sale without any additional packaging other than a label; provides a protected area for a label; is attractive enough to be appealing to consumers; and is obvious enough to be readily understood by consumers.

Further objects and advantages of my invention are to provide a combined fluid and sheet material dispensing system which: provides control over sheet products such that they do not accidentally self-dispense, both in use and in storage; provides means for a single sheet to be dispensed without requiring a second hand to restrain the remainder of undispensed sheets; allows the user a free hand to use dispensed products; does not in any part need to be set down in use or during use of any subsequent products dispensed from it; eliminates negatives of typical roll-dispensing systems, such as off-perforation tearing, overdispensing, unraveling, or the necessity of two handed dispensing; allows for simple, pop-up dispensing of sheet materials; and provides truly one-handed mobile operation, allowing constant, uninterrupted use both from location to location and within a location.

Although the description above contains many specificities, these should not be construed as limiting the scope of the invention, but rather as illustrations of some of the presently prefered embodiments of this invention. Many other variations are possible. For example: the overall shape of the systems could change in appearance while essentially maintaining the same functionality; the hub stem could be longer or shorter; towels could be folded longitudinally more than once or not at all; different types of sprayers, pumps or fluid dispersal systems could be use, or no system at all, with the fluid simply poured out; the towel dispenser need not be pop-up; the system could be scaled up or down in size; it could be fixably or removably mounted to a surface; it could dispense any kind of liquid; it could dispense powders, granules, gases or other materials instead of liquids; it could dispense any kind of sheet material; it could be intended for use in a different orientation; proportion of fluids to sheets could be changed; non-structural portions could be cut away; the dispensing slit could be of a different shape; the bottle could be designed for a different grip, etc.

Thus the scope of the invention should be determined by the appended claims and their legal equivalents, rather than by the examples given.

I claim:

1. In a combined dispensing system for the dispensing of dissimilar yet related products, and more specifically for the combined dispensing of sheet and fluid products, the invention comprising:

(a) a sheet dispenser comprising:
- a sheet-holding enclosure,
- a dispensing opening in said sheet holding enclosure, and
- a sheet supply of sheet material of a pattern and grouping appropriate for dispensing through said dispensing opening, (b) a fluid dispenser comprising:
- a fluid-holding container, and
- dispensing means for dispensing fluid from said container, and (c) integral capping means for allowing said fluid dispenser to act as a removable cap to access and refill stored sheets in the sheet dispenser and in which said capping means further serve as the primary means by which said sheet dispenser and fluid dispenser are connected together to form a combined sheet and fluid dispenser, said integral capping means when employed further allowing full access to said dispensing opening, said integral capping means comprising:
- an integral lid shape formed together with said fluid-holding container,
- a cappable opening in said sheet-holding enclosure, and
- connecting means for repeatable unattachment and reattachment between said integral lid shape and said cappable opening, whereby the manufacturer saves cost which would normally have been expended towards a separate lid, towards further attachment means for joining said sheet dispenser and said fluid dispenser, and towards additional assembly costs; whereby weight is minimized, providing for a more lightweight and easier to carry and use system for the consumer and providing for reduced shipping costs for the manufacturer; whereby an uncomplicated and easy to understand system with a minimal number of parts is presented to the consumer both upon first inspection when seen on supermarket shelves and upon further use at home; and whereby an inexpensive and easy to use combined fluid and sheet dispensing system is provided for the consumer.

2. The system of claim 1, wherein said sheet dispenser is a pop-up dispensing system, whereby a portion of a single sheet is presented through said opening and the grasping and withdrawal of the presentment through said opening causes said sheet dispenser to dispense that single sheet, such action leaving a portion of the next sheet held in said opening and similarly presented for the next use.

3. The system of claim 1, wherein said connecting means are integrally formed together with said fluid holding container and said sheet-holding enclosure, whereby further manufacturing cost is saved.

4. The system of claim 3, wherein said integral connecting means are mating snap-grooves.

5. The system of claim 4, wherein said mating snap grooves are engaged by the action of the rim of said cappable opening snapping over said integral lid shape.

6. The system of claim 4, wherein said mating snap grooves are engaged by the action of the rim of said cappable opening snapping into said integral lid shape.

7. The system of claim 1, wherein said fluid holding container and said sheet-holding enclosure, when said integral capping means are employed, themselves form an internal cavity fully containing said sheet supply, whereby said sheet supply is protected from contamination and physical deformation.

8. The system of claim 1, wherein said fluid holding container and said sheet-holding enclosure, when said integral capping means are employed, themselves form an internal enclosure containing said sheet supply, said internal enclosure formed to house a roll with a core and formed to include integral roll-locating hubs, whereby said roll may freely spin within said internal cavity.

9. The system of claim 1, wherein the sheet dispenser serves as a base or stand for the fluid dispenser.

10. In a combined dispensing system for the dispensing of dissimilar yet related products, and more specifically for the combined dispensing of sheet and fluid products, the invention comprising:

(a) a fluid dispenser comprising:
a fluid-holding container, and
dispensing means for dispensing fluid from said container, and (b) a sheet dispenser comprising:
a sheet-holding enclosure,
a dispensing opening in said sheet holding enclosure, and
a sheet supply of sheet material of a pattern and grouping suitable for pop-up dispensing through said dispensing opening, (c) connecting means for repeatable unattachment and reattachment between said fluid dispenser and said sheet dispenser, and (d) pop-up dispensing means for allowing said sheet supply to be dispensed through said opening such that a portion of a single sheet is presented through said opening and the grasping and withdrawal of the presentment through said opening causes said sheet dispenser to dispense that single sheet, such action leaving a portion of the next sheet held in said opening and similarly presented for the next use, whereby the user may, while walking and without reliance on any surface for placement of any items, dispense fluid with one hand and sheets with the other and thus always have a free hand to wipe with while moving and cleaning uninterruptedly from location to location and within a given location and without concern that sheets may accidentaly self-dispense either in use or, when the user is finished, in storage, hereby the user is afforded an easy to use, convenient, and truly mobile system for the combined ispensing of fluid and sheet products.

11. The system of claim 10, wherein said connecting means are integrally formed together with said fluid holding container and said sheet-holding enclosure, whereby further manufacturing cost is saved.

12. The system of claim 11, wherein said integral connecting means are mating snap-grooves.

13. The system of claim 10, wherein said fluid holding container and said sheet-holding enclosure, when said integral standing means are employed, themselves form an internal cavity fully containing said sheet supply, whereby said sheet supply is protected from contamination and physical deformation.

14. The system of claim 10, wherein said fluid holding container and said sheet-holding enclosure, when said integral standing means are employed, together form an internal enclosure containing said sheet supply, said internal enclosure formed to house a roll with a core and formed to include integral roll-locating hubs, whereby said roll may freely spin within said internal cavity.

15. The system of claim 10, wherein the fluid dispenser serves as a cap or lid for the sheet dispenser.

16. A method for dispensing combined dissimilar, yet related products, and more specifically a method for dispensing sheet and fluid products in combination, said method comprising the steps of:

(a) providing a sheet dispenser comprising:
a sheet-holding enclosure,
a dispensing opening in said sheet holding enclosure, and
a sheet supply of sheet material of a pattern and grouping appropriate for dispensing through said dispensing opening, (b) providing a fluid dispenser comprising:
a fluid-holding container, and
dispensing means for dispensing fluid from said container, and (c) providing an integral capping means for allowing said fluid dispenser to act as a removable cap to access and refill stored sheets in the sheet dispenser and in which said capping means further serve as the primary means by which said sheet dispenser and fluid dispenser are connected together to form a combined sheet and fluid dispenser, said integral capping means when employed further allowing full access to said dispensing opening, said integral capping means comprising:
an integral lid shape formed together with said fluid-holding container,
a cappable opening in said sheet-holding enclosure, and
connecting means for repeatable unattachment and reattachment between said integral lid shape and said cappable opening, whereby the manufacturer saves cost which would normally have been expended towards a separate lid, towards further attachment means for joining said sheet dispenser and said fluid dispenser, and towards additional assembly costs; whereby weight is minimized, providing for a more lightweight and easier to carry and use system for the consumer and providing for reduced shipping costs for the manufacturer; whereby an uncomplicated and easy to understand system with a minimal number of parts is presented to the consumer both upon first inspection when seen on supermarket shelves and upon further use at home whereby an inexpensive and easy to use combined fluid and sheet dispensing system is provided for the consumer.

17. The system of claim 16, wherein said the providing said sheet dispenser further comprises providing a pop-up dispensing system, whereby a portion of a single sheet is presented through said opening and the grasping and withdrawal of the presentment through said opening causes said sheet dispenser to dispense that single sheet, such action leaving a portion of the next sheet held in said opening and similarly presented for the next use.

18. The method of claim 16, wherein the step of providing said connecting means further comprises the step of are integrally formed said connecting means together with said fluid holding container and said sheet-holding enclosure, whereby further manufacturing cost is saved.

19. The system of claim 16, wherein the step of providing and subsequently employing said capping means further comprises the step of forming between said fluid holding container and said sheet-holding enclosure an internal cavity fully containing said sheet supply, whereby said sheet supply is protected from contamination and physical deformation.

20. The system of claim 16, wherein the step of providing the sheet dispenser further comprises the step of forming an integral base or stand for the fluid dispenser into the sheet dispenser.

* * * * *